United States Patent [19]

Lindauer

[11] 4,212,089

[45] Jul. 15, 1980

[54] PROCESS FOR AROMATIZING AND/OR DEODORIZING THE ENVIRONMENT SURROUNDING THE FLUSH TANK OF A TOILET

[75] Inventor: Jerome Lindauer, Hillsdale, N.J.

[73] Assignee: International Flavors & Fragrances Inc., New York, N.Y.

[21] Appl. No.: 32,747

[22] Filed: Apr. 24, 1979

Related U.S. Application Data

[63] Continuation-in-part of Ser. No. 958,492, Nov. 7, 1978, Pat. No. 4,168,550.

[51] Int. Cl.[3] ..... E03D 9/02

[52] U.S. Cl. ..... 4/228; 4/222; 4/227; 222/57

[58] Field of Search ..... 4/228, 222, 227, 224, 4/223; 222/57, 222, 223, 224

[56] References Cited

U.S. PATENT DOCUMENTS

| | | | |
|---|---|---|---|
| 2,331,589 | 10/1943 | Addlesburger | 4/228 |
| 3,327,325 | 6/1967 | Roger | 4/227 |
| 3,521,306 | 7/1970 | Jacobs | 4/228 |
| 3,760,433 | 9/1973 | Mallin | 4/228 |
| 3,768,104 | 10/1973 | Sanderson | 4/227 |
| 3,914,805 | 10/1975 | Dolan | 4/227 |
| 4,064,573 | 12/1977 | Calderone | 4/227 |

*Primary Examiner*—Henry K. Artis
*Attorney, Agent, or Firm*—Arthur L. Liberman

[57] ABSTRACT

Described in a process for aromatizing and/or deodorizing the environment surrounding the flush tank of a toilet by using a detachably affixable and refillable attachment for the flush tank which produces a cleanser and/or sanitizer and/or deodorant and/or aromatizing solution with the water stored in the flush tank and which produces an emission into the atmosphere surrounding the flush tank of an aromatizing and/or deodorizing substance for discrete time periods during each flushing cycle without the use of complicated appurtenances, such as aerosol spray cans. The attachment is substantially contained within the flush tank of the toilet and is actuated in response to the level of the water in the tank.

14 Claims, 25 Drawing Figures

FIG.1
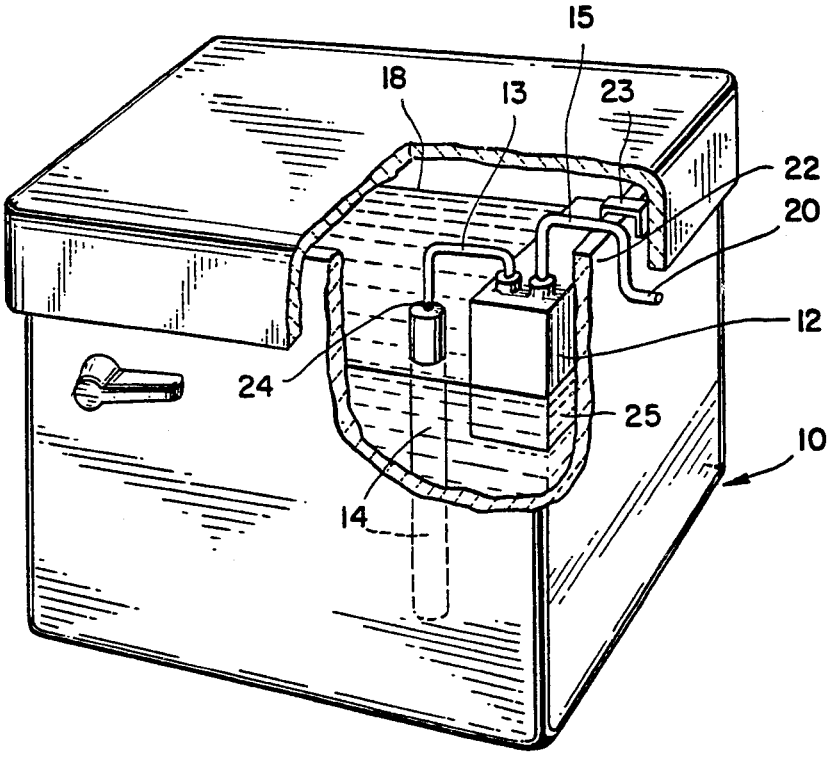
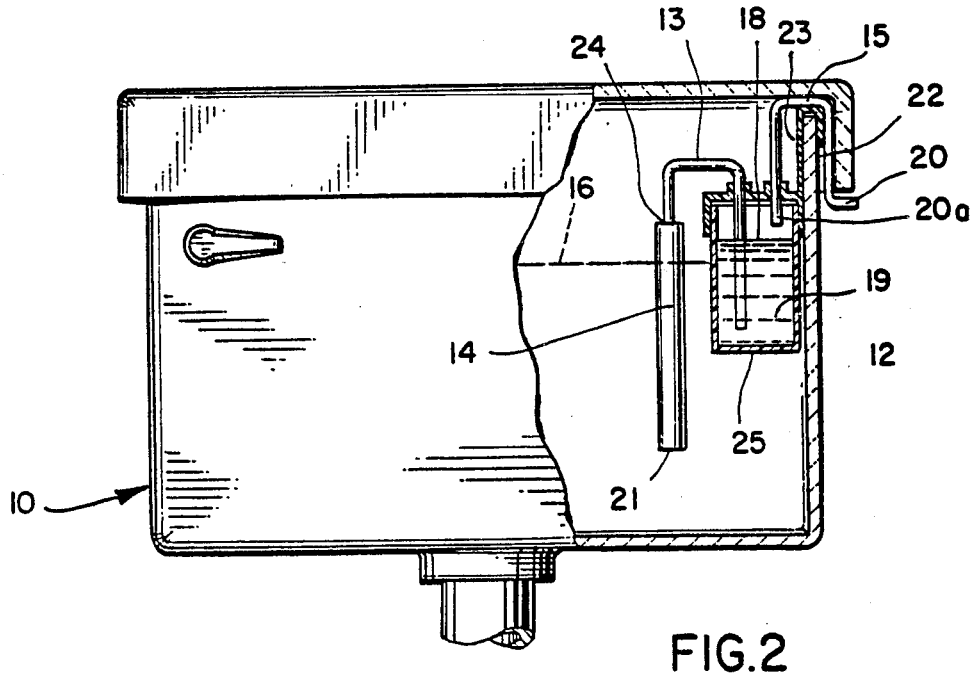
FIG.2

FIG.7
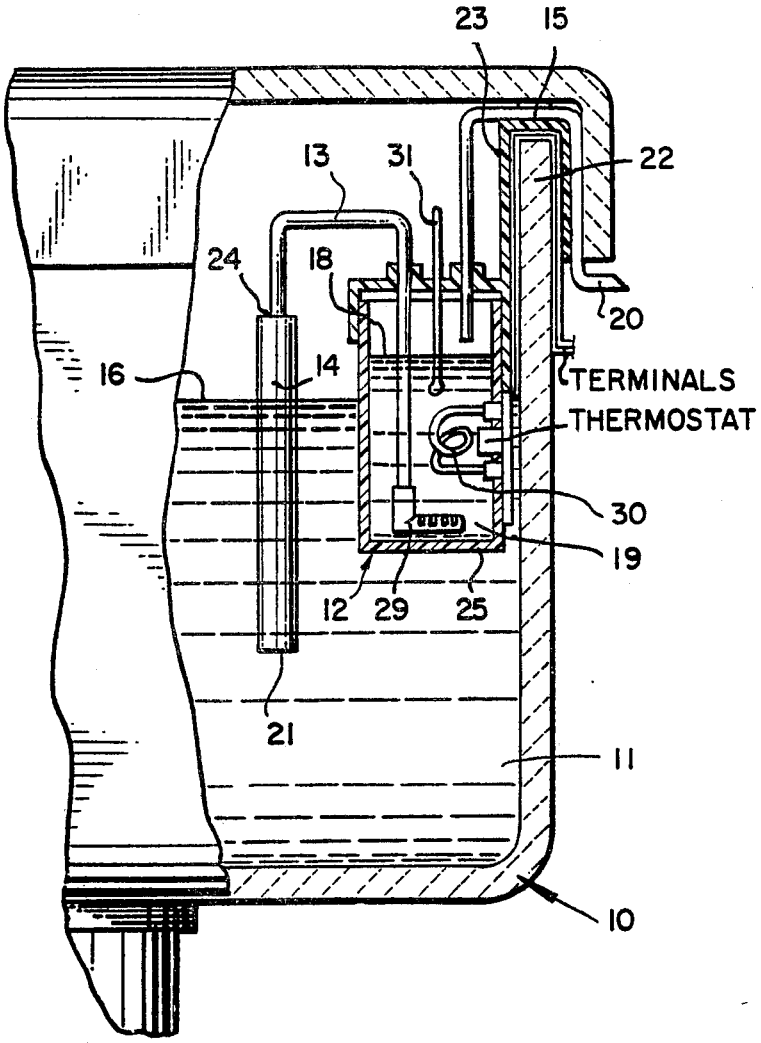
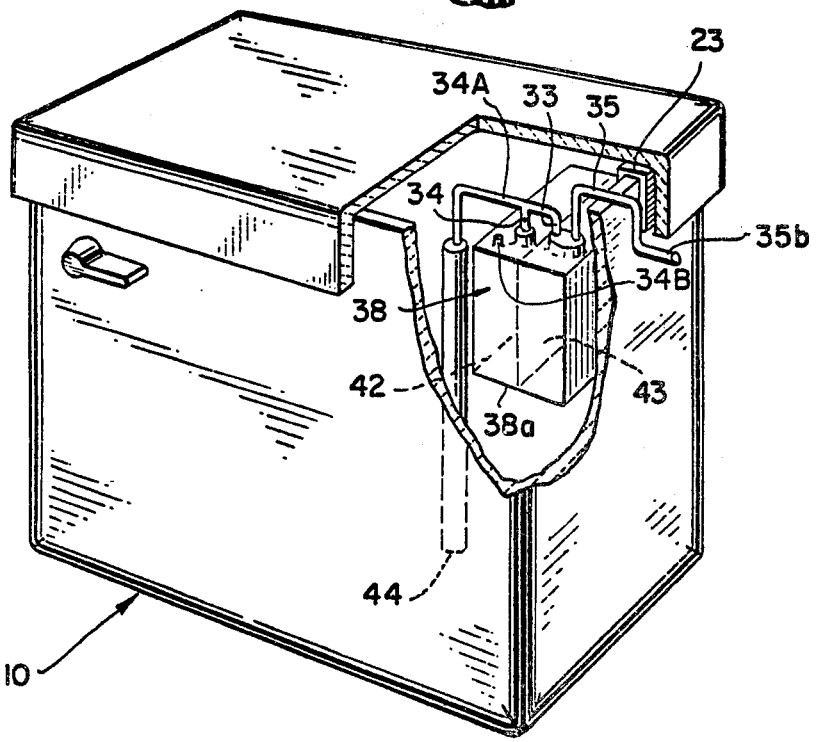
FIG.8

FIG. 9
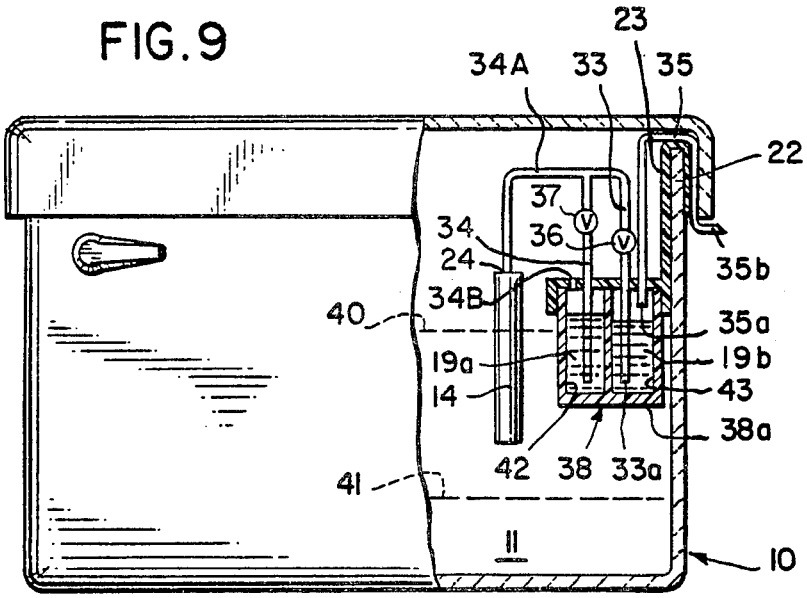
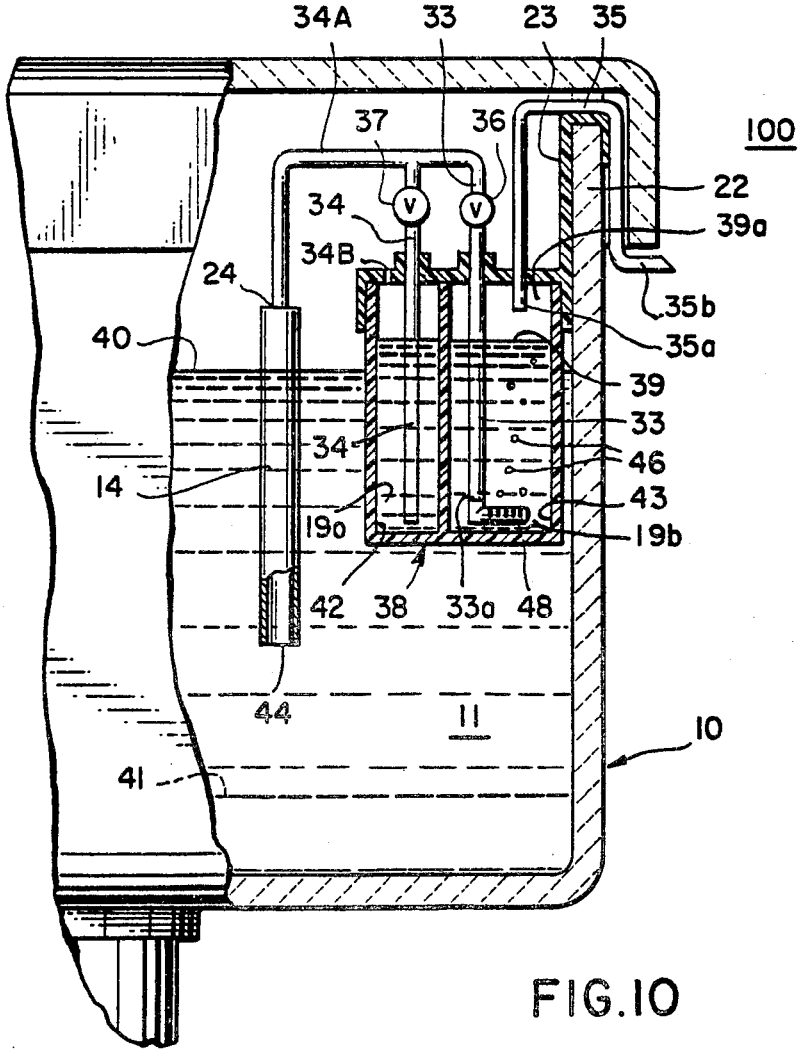
FIG. 10

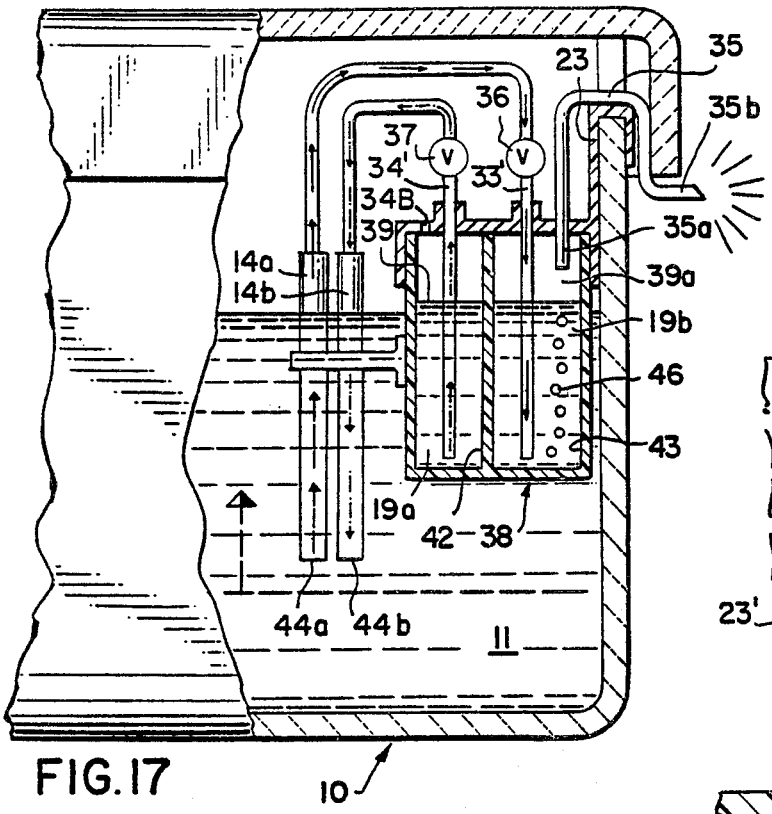
FIG.17
FIG.18
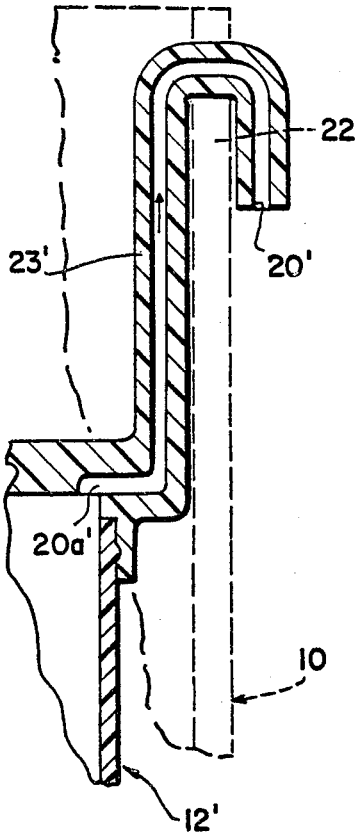
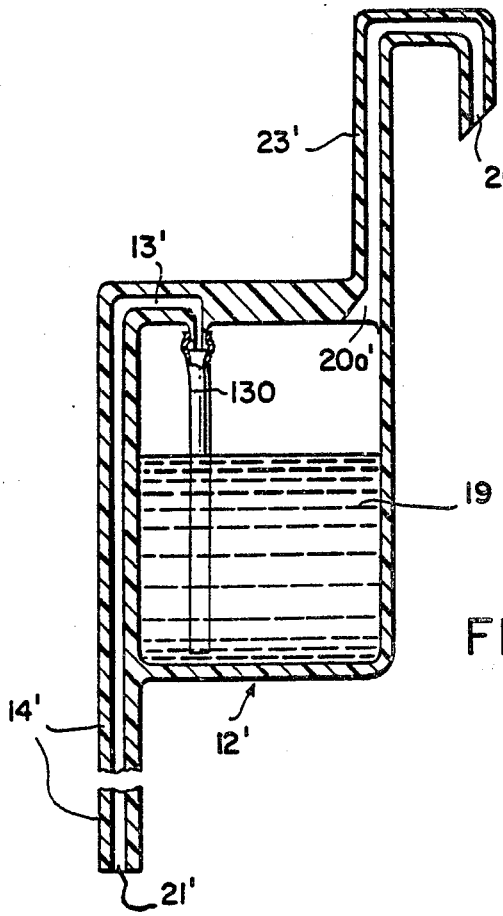
FIG. 19

PROCESS FOR AROMATIZING AND/OR DEODORIZING THE ENVIRONMENT SURROUNDING THE FLUSH TANK OF A TOILET

This application is a continuation-in-part of application for U.S. Letters Patent Ser. No. 958,492 filed on Nov. 7, 1978, now U.S. Pat. No. 4,168,550 issued on Sept. 25, 1979.

BACKGROUND OF THE INVENTION

This invention relates generally to a process for using dispensing devices and more particularly to a process for using such devices to produce a cleansing and/or sanitizing and/or deodorizing and/or aromatizing solution in the water of a toilet flush tank and to produce an aromatizing and/or deodorizing emission of fixed duration to aromatize and/or deodorize the air in the vicinity of the toilet. Such aromatizing and/or deodorizing emission is of a non-aerosol spray type.

The soil and odor associated with a conventional toilet is a source of considerable concern to many people. One need merely consider the quantity of advertising directed to products for cleaning toilets and for freshening and aromatizing the air surrounding same to gain some insight into the concern directed towards the problem. With the possible exception of food preparation areas in the kitchen, the typical housewife probably cleans the bathroom toilet significantly more often than other areas in the home. As substantial a problem as this may be in the household, it is even a more pressing problem in public restrooms which are supplied with flush tank toilets. Not only are such public restrooms used significantly more often than the bathroom in a residence, they are used by transients who have little pride or concern in the appearance or condition of the toilet facility they leave behind. Because of the lack of sanitation associated with them, significant portions of our population are reluctant to use public toilet facilities.

Numerous efforts have been directed towards solving the problem of sanitation and odor in bathrooms in general, and in particular, those toilet facilities associated with public places. An enthusiastic housewife may clean the toilets of a private residence daily. Many public toilet facilities have full time attendants to maintain cleanliness in the facility. Any number of devices have been tried to produce sanitary surroundings being odor free or having a pleasant rather than aesthetically displeasing surrounding aromas in such public accommodations. These devices have run the gamut from liquid dispensers to electronic odor neutralizers, to aerosol spray devices that operate on timed cycles to apparatus connected to each toilet within a facility.

U.S. Pat. No. 4,064,573, (Calderone), disclosed a cleanser-sanitizer and timed cycle deodorizing spray attachment for toilets wherein an attachment for a toilet is disclosed which produces a cleanser-sanitizer solution with the water stored in the flush tank and which produces an aerosol spray of deodorizer for a fixed duration midway through each flushing cycle. The Calderone device is a complicated aerosol can-containing device which carries with it the usual problems associated with the use of aerosol containers well known to one having ordinary skill in the art.

U.S. Pat. No. 3,953,902 issued on May 4, 1976, (G. N. Taylor), discloses a device for introducing an additive liquid into a flush tank of a "water closet". When the "water closet" is flushed and the water level in the tank lowers from a first normal level to a second lower level, air is admitted into a conduit means. As the water level later rises from the second level toward the first level, the admitted air is forced through the conduit means into a container containing an additive liquid where it is compressed. The compressed air forces a portion of the additive liquid through second conduit means and into the water in the tank. The Taylor U.S. Pat. No. 3,953,902, does not disclose a means for causing the occurrence of a pleasant aroma emission and/or deodorant emission into the air surrounding the water closet midway through the flushing cycle.

U.S. Pat. No. 3,914,805 issued on Oct. 28, 1975, (Dolan), discloses a room deodorizing device adapted to be mounted on a flush tank of a toilet which includes an arrangement for dispensing perfume on a continuous basis into the room surrounding the toilet and to replenish or provide an incremental concentration of perfume to the room atmosphere automatically in response to the actuation of the toilet flush tank. The Dolan Patent, U.S. Pat. No. 3,914,805, does not, however, have a feature which employes a solution containing cleansing and/or sanitizing and/or deodorizing and/or aromatizing liquid for the flush tank and aromatizing and/or deodorizing material which can be emitted into the atmosphere around the flush tank from the same dispenser, operating in a synergistic manner. This is also the case with U.S. Pat. No. 3,715,765, issued on Feb. 13, 1973, (Yadro), wherein a perfume or deodorant is dispensed from an absorbent material whenever a water closet is flushed. The absorbent material of Yadro is over an air opening in a chamber which is filled with water after the water closet is flushed so that air is expelled through the absorbent material containing deodorant and a small quantity is carried into the room air. In the Yadro patent, the absorbent material may form the top of a chamber normally containing air and water or may be supported on a tray which forms the top or the absorbent material may initially be sealed with or enclosed by water soluble materials.

U.S. Pat. No. 2,795,799, (Dickerman), discloses an aerosol deodorant can that is actuated by a downward pressure on the seat of a conventional toilet. In 1962, N. W. Price disclosed, in U.S. Pat. No. 3,068,492, apparatus for attaching an atomizer deodorant can to the outside of a toilet flush tank to be actuated whenever the flush handle is depressed. D. T. Behringer, in U.S. Pat. No. 3,023,427, issued in 1962, disclosed a device which could be located within the flush tank of a conventional toilet and is effective for sterilizing and deodorizing the bowl of the toilet. Apparatus was disclosed in 1963 by M. Kaplan in U.S. Pat. No. 3,093,835, for locating a spray deodorizer within the flush tank of a conventional toilet and discharging a deodorant spray outside the flush tank into the air of the room surrounding the toilet.

The devices of the prior art have not been totally satisfactory in resolving the problems discussed. None of these devices is effective both within the toilet and in the surrounding atmosphere (proximate to the toilet) as well. The devices disclosed by Dickerman, Price and Kaplan are effective only to discharge a deodorant spray into the air. Such devices are completely ineffective for cleansing the toilet bowl of fecal residue and insuring that the bowl is in a sanitized condition at the completion of the flush cycle. Conversely, Behringer's device is associated only with flush water discharged into the toilet bowl. It is completely ineffective for overcoming flatulence or fetor from the bowl effluvium which may have escaped from the bowl area to foul the air surrounding the toilet.

OBJECTS OF THE INVENTION

It is therefore an object of my invention to provide a process for both (i) cleansing and/or sanitizing and/or deodorizing and/or aromatizing the bowl of a toilet and (ii) for aromatizing and/or deodorizing in a pleasant manner the air proximately surrounding the toilet with the cleansing and/or sanitizing and aromatizing and/or deodorizing composition contained in the same container and either in an identical solution or in two solutions (one for mixing with the flush tank liquid and the second for emission into the atmosphere proximately surrounding the flush tank) and being utilized in two sequential phases of the flushing cycle of the toilet flush tank.

It is also an object of my invention to provide a process for using cleansing and/or sanitizing and aromatizing and/or deodorizing apparatus which is located substantially within the flush tank of a toilet with the cleansing and/or sanitizing and aromatizing and/or deodorizing composition(s) being contained in an ordinary container at substantially atmospheric pressure; not an aerosol-type device which is constantly under very high pressure.

It is a further object of my invention to provide a process for cleansing and/or sanitizing and/or deodorizing and/or pleasantly aromatizing that uses apparatus that operates automatically in response to the toilet flush cycle whereby the cleansing and/or sanitizing and the deodorizing and/or pleasantly aromatizing composition(s) are contained in the same container and are utilized in sequential phases during the toilet flush cycle.

It is yet another object of my invention to provide an aromatizing and/or deodorizing emission that is safe and automatically actuated during the mid-portion phase of the flush cycle when the water level of the toilet bowl ebbs and the bowl begins to refill.

It is still another object of my invention to provide a deodorizing and/or pleasantly aromatizing process which utilizes apparatus which contains a timing means for the intermittent discretely apportioned release of the aromatizing and/or deodorizing emission in a non-aerosol manner from the apparatus for a predetermined time after each flushing operation.

In accordance with the present invention, a process is disclosed for both (i) producing a first cleanser and/or sanitizer and/or aromatizer and/or deodorizer solution in the water in the flush tank of a toilet (preferably containing cleanser and/or aromatizer) and (ii) producing (in a non-aersol manner) for a fixed period of time an aromatizing and/or deodorizing emission from a container and/or sanitizer and/or deodorizer and/or aromatizer solution and (ii) the second deodorizing and/or pleasantly aromatizing solution during the middle of each flush cycle.

BRIEF DESCRIPTION OF THE DRAWINGS

FIG. 1 is a partial cut-away perspective view of the apparatus in accordance with my invention in place in a flush tank with the flush tank full immediately prior to commencement of the flush cycle.

FIG. 2 is a partial cut-away elevation view of the apparatus of FIG. 1 shown in cross-section with the flush tank full immediately prior to commencement of the flush cycle.

FIG. 7 is a partial cut-away elevation view of a section in detail of the apparatus in accordance with my invention in place in a flush tank as shown in FIG. 1, showing a heating element and temperature regulating means (or "thermostat means") used in conjunction with the additive liquid contained in the container of my apparatus whereby the temperature of the additive liquid is maintained at steady state at a level above room temperature (e.g., 45° C.) as a result of the automatic regulation of the heating elements' energy output using the "thermostat means".

FIG. 8 is a partial cut-away perspective view of the apparatus in accordance with my invention in place in a flush tank, said apparatus comprising a two-compartment container for holding additive liquid and integrated with said container, three conduit means, two of the conduit means leading from the container portion of the apparatus of my invention into the flush tank through a common tube associated with the apparatus of my invention and a third conduit means leading from the apparatus of my invention into the proximate atmosphere surrounding the flush tank.

FIG. 9 is a partial cut-away elevation view of the apparatus of FIG. 8 shown in cross-section and illustrating in cross-section the apparatus of my invention comprising three conduit means leading therefrom.

FIG. 10 is a partial cut-away elevation view of a section in detail of the apparatus of FIG. 8 of my invention, in place in a flush tank (as shown in perspective in FIG. 8), shown in cross-section containing two different additive liquids therein and having attached to a conduit means leading into the container means of the apparatus of my invention, a sparger.

FIG. 17 is an elevation view of a variation of the apparatus of FIG. 10 shown in cross-section with additive liquid contained in each of the compartments of the container means of the apparatus of my invention, shown in operation during the second phase of the flushing cycle wherein each of the three conduit means is separate and distinct from one another and whereby air is forced (under pressure of the rising fluid in the flush tank) through the second conduit means (in the direction of the arrows) into the second container compartment of the container means and through the orifice located at the container end close to the bottom of the container means whereby the moving pressurized air forms bubbles at said orifice and the bubbles travel in an upward direction through the additive liquid in the second compartment of the container means to the surface of said additive liquid in the container means and then the air above said surface containing the aromatizing and/or deodorizing substance travels through the third conduit means into the proximate atmosphere surrounding the flush tank.

FIG. 18 is a detailed cross-sectional view of a variation of the third conduit means of the apparatus of my invention in which variation said third conduit means is an integral part of the mounting clip for the remainder of the apparatus of my invention.

FIG. 19 is a cross-sectional view in perspective of a variation of the apparatus of my invention wherein each of the conduit means and container means are integrated into an indivisible unit, with that conduit means which leads to the atmosphere proximate to the flush tank also being an integral part of the mounting clip for the remainder of the apparatus of my invention.

OPERATION OF A FIRST ILLUSTRATIVE EMBODIMENT

Figure 4:
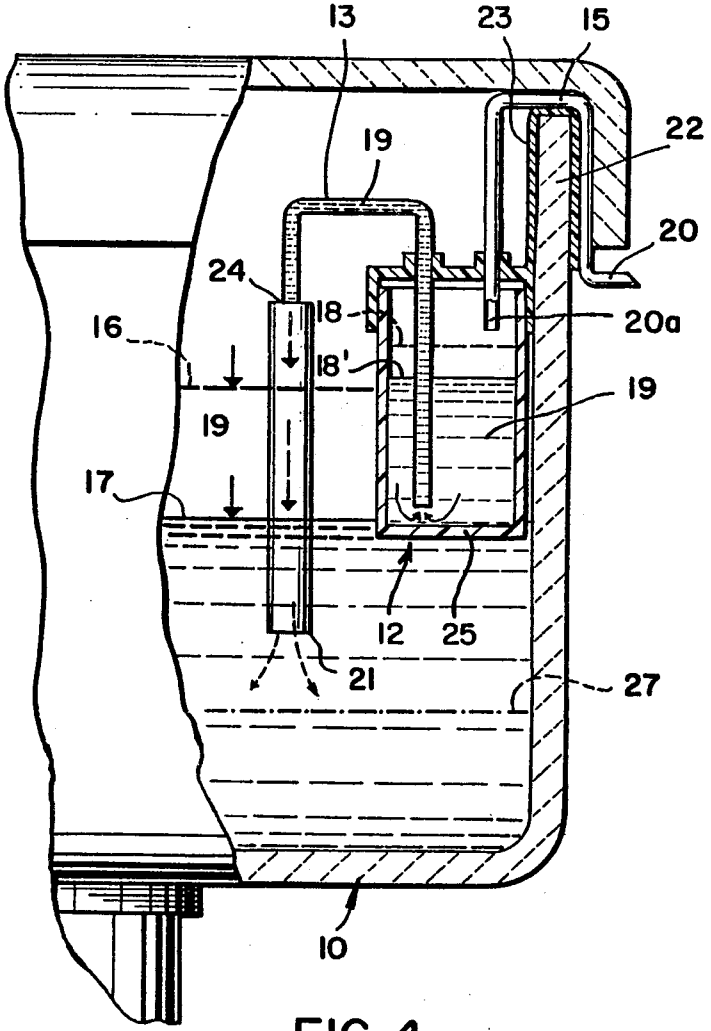
FIG. 4 is an elevation view of the apparatus of FIG. 3 shown in cross-section midway through the first phase (phase I) of the flush cycle wherein cleanser and/or sanitizer and/or aromatizer and/or deodorizer solution (also referred to herein as "additive liquid") is passing from the apparatus of our invention into the flush tank water.

A principal feature of my invention is the provision of a process for introducing an additive liquid into a flush toilet which additive liquid has a cleanser and/or sanitizer and/or aromatizing and/or deodorizing function and, over the same toilet flush cycle, effecting pleasant aromatization and/or deodorization of the atmosphere proximate to the flush toilet, in a simplified manner without the necessity of involving the use of aerosol spray cans or similarly constructed complicated devices.

Thus, during the first phase of the flush cycle ("Phase I") as the water level in the toilet flush tank containing apparatus embodying my invention drops, a small portion of the cleansing and/or sanitizing and/or aromatizing and/or deodorizing fluid body contained within the apparatus of my invention siphons from the container means of the apparatus of my invention through conduit means into the toilet flush tank until the liquid level of the flush tank drops below the outlet of the conduit means (e.g., tube) connecting the additive liquid in the container means of the apparatus of my invention with the liquid in the flush tank.

The design and the range of the diameters of the conduit means (e.g., tube) carrying the additive liquid from the container means to the fluid located in the flush tank during the first phase (Phase I) of the flush cycle when the fluid level of the flush tank drops must be such that during said phase I, a fraction (e.g., 1–2%) of the additive fluid siphons out of the container means of my apparatus through said conduit means into the flush tank; and, preferably, the siphon of additive fluid ceases when the flush tank fluid level drops below the flush tank and (orifice) of the conduit means. More specifically, the time $\theta$ of the phase I of the flush cycle must be such that the volume V of additive liquid originally stored within the container means, from 0.01 V up to 0.02 V flows into the flush tank.

Such design of the conduit means is not only a function of its overall shape, length and diameter, but also the material of its construction, e.g., teflon or stainless steel) and the physical properties of the additive fluid (e.g., viscosity, density and temperature).

Furthermore, the aforementioned desired boundary conditions for the flow of said additive liquid is governed by application of the energy balance equation:

[Change in kenetic energy + change in potential energy + friction loss + sudden expansion or contraction loss = 0]

or $$\frac{\Delta u^2}{2} + g_c\Delta z + \frac{2fLv_{avg}^2}{g_cD} + \frac{(V_1 - V_2)^2}{2} = 0$$

wherein f, the friction factor is a function of the Reynold's number for the fluid flow occurring, $Dv\rho/\mu$ and wherein the letters in the above equation are defined as follows:

$g_c$ = gravitational acceleration;

$\Delta z$ = difference in height between upper level of additive liquid and level of fluid in flush tank;

$\Delta u^2$ = difference in squares of velocities of fluid in additive liquid container and fluid emitted from end of siphon;

L = length of siphon tube;

D = effective diameter of siphon tube;

$V_1 - V_2$ = difference in velocities of fluid between wide tube and narrow tube if that is the way the conduit means is designed;

$V_{avg}$ = average velocity of fluid;

$\rho$ = density of fluid;

$\mu$ = viscosity of fluid

The techniques for determination of the design of the conduit means using the aforementioned relationships are determined using the following references:

(i) Coulson & Richardson "Chemical Engineering", Volume I—Fluid Flow, Heat Transfer and Mass Transfer—McGraw Hill, 1954, pp. 28–35, 48 and 49; and (ii) Walker, Lewis, McAdams and Gilliland "Principles of Chemical Engineering" 3rd Edition—McGraw Hill, 1937, pp. 86–89

During the second phase (phase II) of the flush cycle, as the fluid level (e.g., water level) rises in the toilet flush tank containing apparatus embodying my invention, as soon as the rising water contacts the conduit means (e.g., tube) which is in communication with both the liquid of the toilet flush tank and the additive liquid which is located in the container means of the apparatus of my invention (the cleanser and/or sanitizer and/or aromatizing and/or deodorizing solution) in the apparatus of my invention, forces air under pressure into the additive liquid located in the container means of the apparatus used in carrying out the process of my invention and through said additive liquid into the proximate atmosphere surrounding the toilet flush tank. Necessarily, as the air passes through said additive liquid, it passes therethrough in the form of bubbles, the bubble size and bubble residence time (or additive liquid-air bubble contact time) depends upon the diameter of the orifice of the conduit means (or tube) communicating between the additive liquid located in the container means of the apparatus used in carrying out the process of my invention and the liquid in the toilet flush tank at each end of said communicating conduit means; as well as the difference of height $\Delta H$ between (1) the additive liquid located in the container means of the apparatus used in carrying out the process of my invention and (2) the level of the liquid in the flush tank; the rate of change of $\Delta H$ with respect to time ($d\Delta H/dt$) the height H, the density $\rho$ and the viscosity $\mu$ of the additive liquid stored in the container means. As the bubbles pass through the additive liquid (the cleanser and/or sanitizer and/or aromatizer and/or deodorizer solution) a quantity of aromatizing material and/or deodorizing material present in the additive liquid diffuses into each bubble of air passing through said additive liquid. The amount of aromatizing and/or deodorizing material diffusing into each bubble and diffusing into the air is a function of the average pressure in each bubble, the temperature of the additive liquid (which may be appropriately regulated); the average surface area of each bubble as it passes through the additive liquid and the average velocity of the bubble as it passes through the additive liquid.

Figure 24:
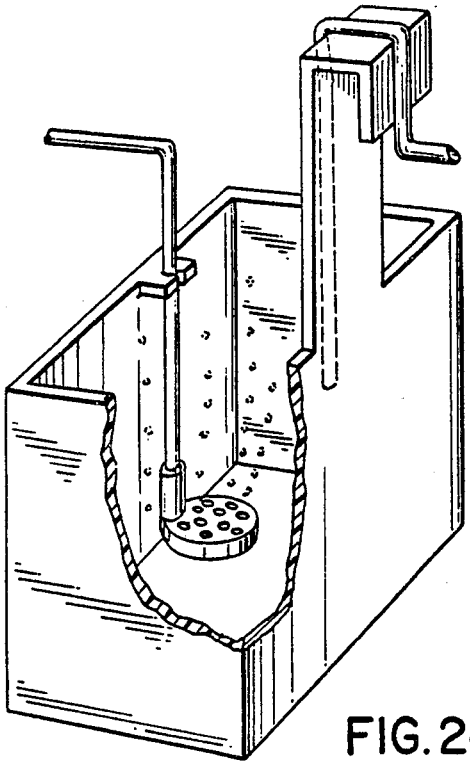
FIG. 24 is a perspective view of a sparger located in container means.

The rate of diffusion of aromatizing and/or deodorizing substance into the air bubbles can thus be substantially increased by means of fitting a sparger or air diffuser appliance onto that end of the conduit means which is located near the base of the container means of the apparatus of my invention. Such a sparger is specifically illustrated in perspective view in FIG. 24. An example of an air diffusing tube is that described in the Derwent Abstract (Week A-31, 1978, pg. 9) of Published Japanese Patent Application No. J5-3073-857 as follows:

> SHIK-* D15 56128A/31 * J53073-857 Air diffusing tube for cleaning water—mfd. by adding pulverised silica-foamed material to synthetic resin and foaming in mould SHIKOKU KAKEN KOGYO 12.12.76-JA-149977 A88 (30.06.78) CO2b-09 CO2c-01/12
>
> The tube is made by adding pulverised, silica-foamed material to synthetic resin which is easy to foam and then foaming a mould.
>
> The tube permits uniform diffusion of fine air bubbles, and causes little or no clogging and small pressure loss.
>
> Synthetic resins include epoxy, phenol, polycarbonate, urethane, ethyl acrylate, styrene, ethylene and vinyl chloride resin or co-polymerised resin of either ≧2 of above.
>
> For moulding purpose pulverised material is added in amt. of 10–50 part (20–40) parts vol. per 100 parts vol. synthetic resin. 12.12.76 as 149977 (3pp6)

The design and the range of diameters of the conduit means (e.g., tube) carrying the air into the container means from the flush tank during the second phase (phase II) of the flush cycle when the fluid level of the flush tank rises must be such that during said Phase II, a fraction (e.g., 0.1–0.2%) of the additive fluid evaporates (simultaneously giving rise to diffusion of aromatizing and/or deodorizing substance) out of the container means of the apparatus used in carrying out the process of my invention through conduit means into the proximate atmosphere surrounding the flush tank. The bubbling of air through the additive fluid ceases when the flush tank fluid level reaches its maximum point; level with the liquid level of the additive liquid stored in the container means. More specifically, the time $\theta$ of the Phase II of the flush cycle must be such that of the volume V of additive liquid originally stored within the container means, from 0.001V up to 0.002V evaporates; and of the quantity of aromatizing and/or deodorizng agent, Q, 0.01Q up to 0.02Q diffuses into the proximate atmosphere surround the flush tank.

Such design of the conduit means is a function of its overall shape, length and diameter and the physical properties of the additive fluid (e.g., viscosity, density and temperature).

Furthermore, the aforementioned desired boundary conditions for the flow of the air is governed by application of the diffusion equation:

$$-\frac{dN}{dA} = K_g(p_g - p_1^*) = K_L(C_g^* - C_1)$$

wherein p equals partial pressure, c equals concentration, N equals number of moles diffusing, A equals area of diffusion and K represents a diffusion constant.

The technique for determination of the design of the conduit means using the aforementioned relationship is determined using the reference, Walker, Lewis, McAdams and Gilliland, "Principles of Chemical Engineering", 3rd Edition—McGraw Hill, pp. 446–451.

The use of the apparatus as described above in this illustrative embodiment avoids entirely the use of a complicated aerosol spray can as is described in U.S. Pat. No. 4,064,573 cited, supra.

Thus, the duration of the time that the aromatizing agent and/or deodorizing agent is discharged into the atmosphere surrounding the toilet and the concentration of aromatizing agent discharged into the air and the amount per unit of time is carefully regulated.

DETAILED DESCRIPTION OF A FIRST ILLUSTRATIVE EMBODIMENT

A unit embodying apparatus used in carrying out the process of my invention is shown in perspective in FIG. 1. The unit is adapted for submersion in the water contained within the flush tank 10 of a conventional flush toilet.

The unit includes a container 12 which is fastened to the walls of the toilet flush tank or to the lip of the toilet flush tank 22 by retaining means 23. Container 12 contains the cleanser and/or sanitizer and/or aromatizing and/or deodorizing solution 19 (also referred to herein as "additive liquid" 19).

Leading out of the container 12 from below the surface of the additive liquid 19 is a siphon tube 13 which is connected at 24 with wider tube 14 which is partially submerged into the toilet flush tank liquid. The tube 14 has an open (free) end 21. The connection between tube 13 and 14 at 24 is at a level above the bottom 25 of container 12. Tube 15 which is an outlet tube also leads away from container 12 from above the level 18 of additive liquid 19 and has an open free end 20 extended into the atmosphere surrounding the toilet flush tank while the opposite end 20a is tube 15 in in container 12 is above the level 18 of the maximum height of the additive liquid 19 located in container 12.

Figure 3:
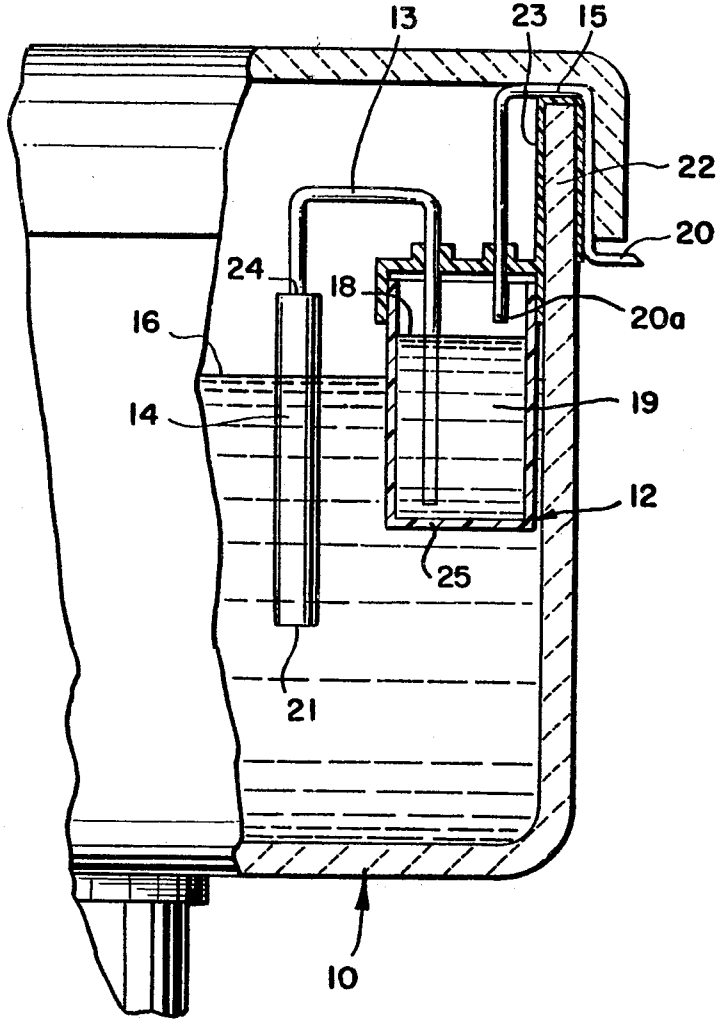
FIG. 3 is a partial cut-away elevation view of a section in detail of the apparatus of FIG. 1 showing the apparatus in accordance with my invention in place in a flush tank (as shown in perspective in FIG. 1) shown in cross-section with the flush tank full immediately prior to the commencement of the flush cycle.

A cross-section of the apparatus used in carrying out the process of my invention in the toilet flush tank prior to the beginning of the toilet flush cycle is illustrated in FIG. 3. At the beginning of the toilet flush cycle, tube 13 leading away from container 12 and into the liquid 11 in toilet flush tank 10 contains liquid from point 18 to 24 and tube 14 also contains liquid to orifice 21.

The side elevation view of the apparatus used in carrying out the process of my invention operating in toilet flush tank 10 is illustrated in FIG. 4 wherein the first phase (phase I) of the flush cycle is under way. Additive liquid 19 commences movement in the direction of the indicated arrows in tube 13 past point 24 through tube 14 through orifice 21 into the liquid 11 in toilet flush tank 10 as the level of the liquid 11 in toilet flush tank 10 proceeds in a downward direction from level 16 to level 27 as soon as the level of liquid 11 in the toilet flush tank 10 goes below level 27 which is immediately below the level of orifice 21 of tube 14 the siphoning of liquid 19 from container 12 ceases and phase I of the toilet flush cycle is at an end. Air is now contained in tube 14 at least up to point 24.

Figure 6:
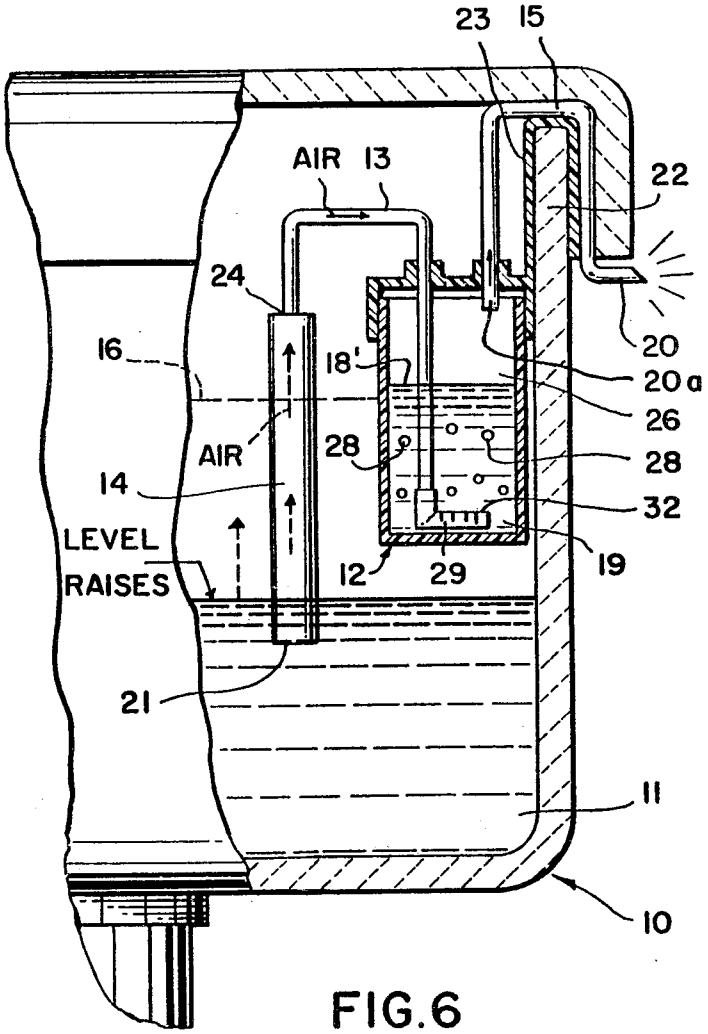
FIG. 6 is an elevation view of the apparatus of FIG. 3 shown in cross-section in operation during the second phase (phase II) of the flush cycle when the water level of the toilet bowl ebbs; the flush tank begins to refill and air is forced by the pressure of the rising liquid in the flush tank through the cleanser and/or sanitizer and/or aromatizer and/or deodorant fluid body (additive liquid) contained in the apparatus of my invention and where a sparger fitting is employed in the apparatus of my invention in order to increase the rate of diffusion of the aromatizing agent and/or deodorizing agent from the additive liquid into the air passing through the additive liquid in said apparatus.
Figure 5:
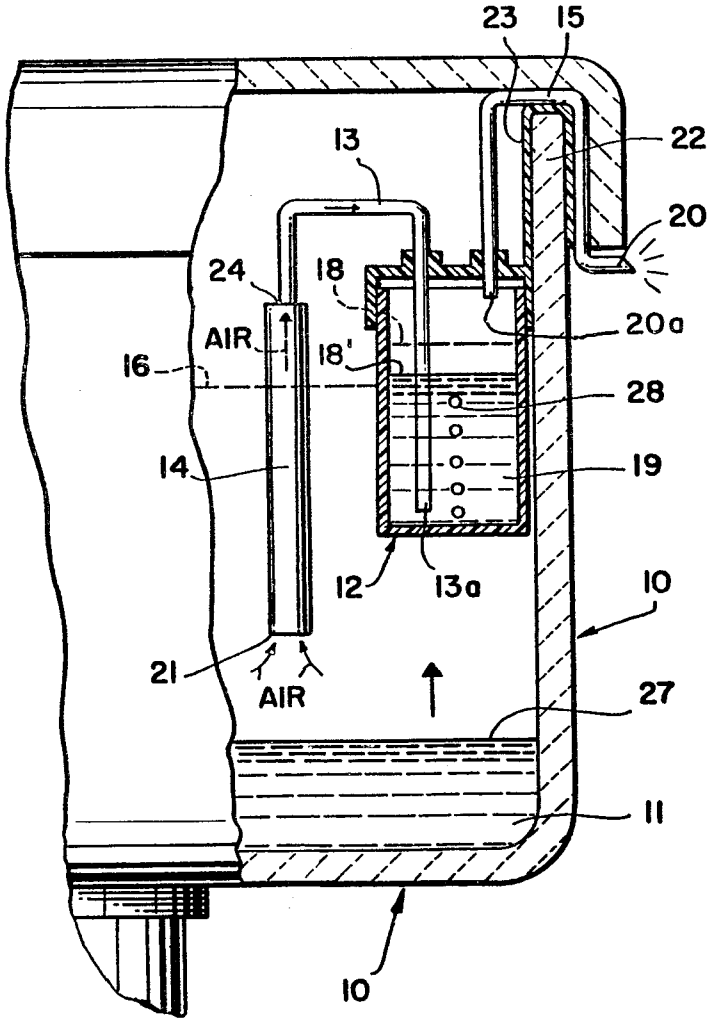
FIG. 5 is an elevation view of the apparatus of FIG. 3 shown in cross-section midway through the second phase (phase II) of the flush cycle wherein as the level of the flush tank liquid rises, air is forced into the apparatus of our invention through the cleanser and/or sanitizer and/or aromatizer and/or deodorizer solution body of fluid contained in the apparatus of our invention and into the atmosphere proximately surrounding the toilet flush tank.

At the level of the liquid 11 in the toilet flush tank 10 begins to rise in phase II of the toilet flush cycle towards level 16, the column of air in tube 14 is forced under pressure of liquid 11 from point 21 of tube 14 past point 24, (the connection between tube 14 and tube 13), through tube 13 in the direction of the arrows (shown in tubes 13 and 14) indicated in FIG. 5 through orifice 13*a* of tube 13 into liquid 19 contained in container 12. As the air passes through orifice 13*a* of tube 13, the air forms bubbles 28 which rise through liquid 19 to the surface of liquid 19, 26. While the air bubbles rise from point 13*a* to surface of liquid 19, aromatizer and/or deodorizer substance dissolved in liquid 19 diffeses into the gaseous phase of each bubble 28 in a continuous manner between orifice 13*a* and surface 26. The air passing through orifice 13*a* may, if desired, pass through sparger 29 as shown in FIG. 6 or an air diffusing tube 130 as shown in FIG. 19. When sparger 29 or air diffusing tube 130, the number of bubbles per unit time passing from point 13*a* to surface 26 is increased and the size of each bubble is smaller. Therefore, the surface area available for diffusion transfer of aromatizing and/or deodorizing substance from the liquid 19 phase to the gaseous bubble 28 phase occurs at a greater rater than if the bubbles were simply emitted from orifice 13*a* without the use of sparger 29 or air diffusing tube 130. In addition, the temperature T of liquid 19 can be controlled by use of heater element 30 as shown in FIG. 7 wherein the temperature T of the liquid 19 is indicated on temperature indicator 31. When using sparger 29 as shown in FIG. 6 and FIG. 7, the holes 32 in sparger 29 must be large enough to allow the siphon effect to occur through tube 13 during phase I of the flush cycle but the holes 32 must be of a small enough diameter whereby good air-additive liquid connect is created to permit efficient and practical diffusion transfer of the aromatizing and/or deodorizing agent from additive liquid 19 held in container 12 into the air bubble gas phase 28.

Although the shape of conduit means are not intended to be limited and the inside effective diameters of conduit means (tubes) 15, 13 and 14 are limited only by the size of container 12, by the physical properties of the additive liquid, e.g., density $\rho$, and viscosity $\mu$, and by the dimensions of the toilet flush tank 10 and by the physical operability requirements for the siphoning effect as indicated supra, it is preferred that each of tubes 13 and 20 (i) are cylindrical and (ii) have inside effective diameters varying from about 0.06 inch up to about 0.03 inch. It is further preferred that the wide tube 14 connected at 24 to tube 13 in each of FIGS. 1, 2,3,4,5 and 6 have an inside diameter of from about 0.25 inches up to about 1.00 inches and that the ratios of the inside diameters of wide tube 14:narrow tube 13 from about 2.5:1 up to 6:1 with a preferred ratio of about 4:1.

OPERATION OF A SECOND ILLUSTRATIVE EMBODIMENT

During the flush cycle I, as the water level in the toilet flush tank containing apparatus used in the process embodying my invention drops, a portion of the cleansing and/or sanitizing and/or aromatizing and/or deodorizing fluid body contained within a first compartment located within the container means of the apparatus of my invention siphons through a first conduit means, through a one-way valve from the apparatus of my invention into the toilet flush tank until the liquid level of the flush tank drops below the outlet of the first conduit means (or tube) connecting the additive liquid in the first compartment located within the container means of the apparatus of my invention with the liquid in the flush tank.

During the second phase of flush cycle, as the water level rises in the toilet flush tank containing apparatus used in the process embodying my invention, the rising water (as soon as it comes in contact with a second conduit means (or tube) wholly or partially distinct from the first conduit means which is in communication with both the liquid of the toilet flush tank and the liquid which is the aromatizing and/or deodorizing solution stored in the second compartment of the container means of the apparatus of my invention) forces, under pressure, air through said second conduit means, through a second one-way valve into the aromatizer and/or deodorizer solution in the second compartment of the apparatus of my invention and through said aromatizer and/or deodorizer solution into the atmosphere surrounding the toilet flush tank. Necessarily, as the air passes through said aromatizing and/or deodorizing solution, it exists in the form of bubbles, the bubble size and rate depending upon the diameter of the orifice of the tube communicating (i) the aromatizer and/or deodorizer solution in the second compartment of the container means of the apparatus of my invention and (ii) the liquid in the toilet flush tank, at each end of said communicating second conduit means; as well as the height of the liquid aromatizing and/or deodorizing solution in the second compartment of the container means of the apparatus of my invention. As the bubbles pass through the aromatizer and/or deodorizer solution, a quantity of aromatizing and/or deodorizing material present in the aromatizing and/or deodorizing solution diffuses into each bubble of air passing through said aromatizer and/or deodorizer solution. The amount of aromatizing and/or deodorizing material diffusing into each bubble and diffusing into the air is a function of the average pressure in each bubble, the temperature of the aromatizer and/or deodorizer solution (which may be appropriately regulated); the average surface area of each bubble as it passes through the solution and the average velocity of the bubble as it passes through the aromatizer and/or deodorizer solution.

As in the case of the operation of the first illustrative embodiment, the use of the apparatus as described above in this second illustrative embodiment avoids entirely the use of a complicated aerosol spray can as is described in U.S. Pat. No. 4,064,573 cited, supra.

Thus, the duration of the time that the aromatizing agent is discharged into the atmosphere surrounding the toilet and the concentration of aromatizing agent discharged into the air and the amount per unit of time is carefully regulated.

DETAILED DESCRIPTION OF A SECOND ILLUSTRATIVE EMBODIMENT

Using the same physical principles as illustrated in the detailed description of the first illustrative embodiment, an alternative unit embodying apparatus used in the process of my invention is shown in perspective in FIG. 8 with a major variation thereof illustrated in FIG. 17.

This unit, too, is adapted for submersion in the water contained in the flush tank 10 of a conventional toilet. Rather than having two conduit means with the same conduit means serving as both (i) the additive liquid feed-line from the container means into the flush tank and (ii) as the air feed-line into the additive liquid during the second phase of the flushing cycle, the apparatus illustrated in perspective in FIG. 8 and illustrated in side elevation view in FIGS. 9, 10, 11, 12, 13, 14, 15, 16 and 17 has three conduit means 33, 34 and 35. In FIGS. 8, 9, 10, 11, 12, 13, 14, 15, 16 and 17, each of the conduit means is cylindrical tubing; preferably teflon, polyethylene, polypropylene, or the like. First conduit means 34 leads from two compartment-container 38 and from compartment 42 of container 38 which compartment holds cleanser and/or aromatizer and/or deodorizer solution into the flush tank 10 containing liquid at level 40 at the beginning of the flushing cycle (just prior to phase I) and at level 41 after the first phase (phase I) of the flushing cycle.

The internal effective diameter of first conduit means 34 is such that the mass flow rate of siphoning additive liquid will be such that if $V_o$ is the original volume of the liquid in compartment 43, then the volume $V_1$ of liquid that will leave compartment 43 from the beginning of phase I of the flush cycle to the initiation of phase II of the flush cycle will be $0.1V_o$ up to $0.02V_o$.

The second conduit means, tube 33 traverses the distance from the compartment 43 of container 38 of the apparatus of my invention to the inlet means 44 of said second conduit means.

In a variation of the apparatus used in the process of my invention, conduit means 33 and 34 may join at junction 34A as in FIG. 10 or they may be separate as in FIG. 17.

Inlet means 44 is midway between level 40 and level 41 but is close enough to level 41 whereby when the flushing liquid level approaches the limit of level 41, air can enter said second conduit means and pass therethrough into the liquid additive substance 44 located in compartment 43 of container 38, which liquid additive substance 44 contains an aromatizing and/or deodorizing liquid which has a substantial volatility at temperatures in the range of 15° C. up to 50° C. (that is, a relatively high vapor pressure at temperatures in the range of 15° C. up to 50° C.).

The first conduit means 34 includes in the tube 34 a one-way ball valve 37 which permits fluid to flow from compartment 42 of container 38 through conduit means 34 past one-way valve 37 into the flush tank 10 as the level of the fluid in flush tank 10 drops from level 40 to level 41. As soon as the first phase of the flush cycle is terminated and the second phase is initiated, the fluid level of the flush tank 10 rises from level 41 to level 40 thereby forcing air under pressure through the second conduit means 33 which may contain one-way valve 36 which will not permit fluid to flow therethrough but will permit air to be forced therethrough as the liquid level rises from level 41 to level 40. The air being forced through second conduit means 33 passes through the end 33A where a sparger 48 may be arranged thereon whereat air bubbles are formed 46 which travel to the upper level of the aromatizing and/or deodorizing fluid **19*b* contained in compartment 43 of container 38. While the bubbles 46 travel through said aromatizing and/or deodorizing fluid 19*b*, aromatizing and/or deodorizing substance diffuses from the fluid 19*b* into the air bubbles 46 so that the space 39*a* above the upper level 39 of the aromatizing and/or deodorizing liquid 19*b* contains aromatizing and/or deodorizing substance and air in the gaseous phase. Above level 39 of the additive fluid contained in compartments 42 and 43 is the outlet 35*a* of third compartment means 35 which follows a path from its orifice 35*a* to outlets 35*b* to the atmosphere surrounding the toilet flush tank 100. Through said third conduit means 35 air and aromatizing and/or deodorizing substance in the gaseous phase in admixture with said air pass when the level of the fluid in the flush tank traverses the distance from level 41 to level 40** in an upward direction.

Figure 12:
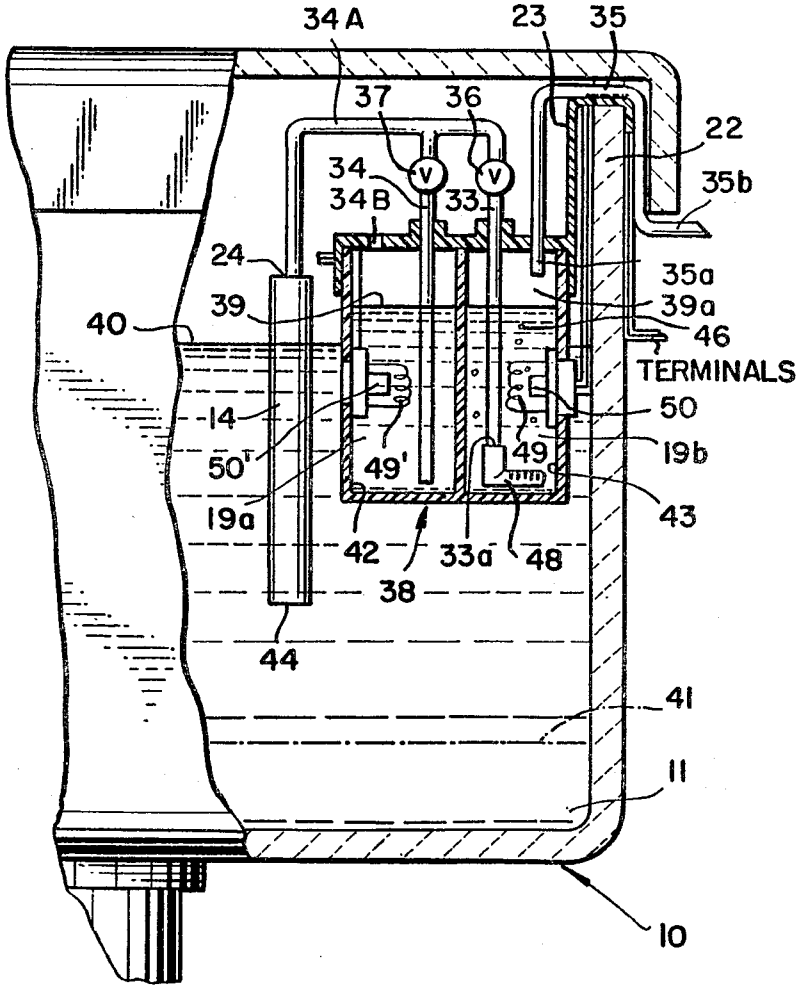
FIG. 12 is an elevation view of the apparatus of FIG. 8 shown in cross-section containing two heating elements; one in the additive liquid containing compartment containing the aromatizer and/or deodorizer solution and the other in the first additive liquid containing compartment containing the cleanser and/or sanitizer and/or aromatizer and/or deodorizer solution that is intended to be admixed in discrete portions with the liquid contained in the flush tank.
Figure 16:
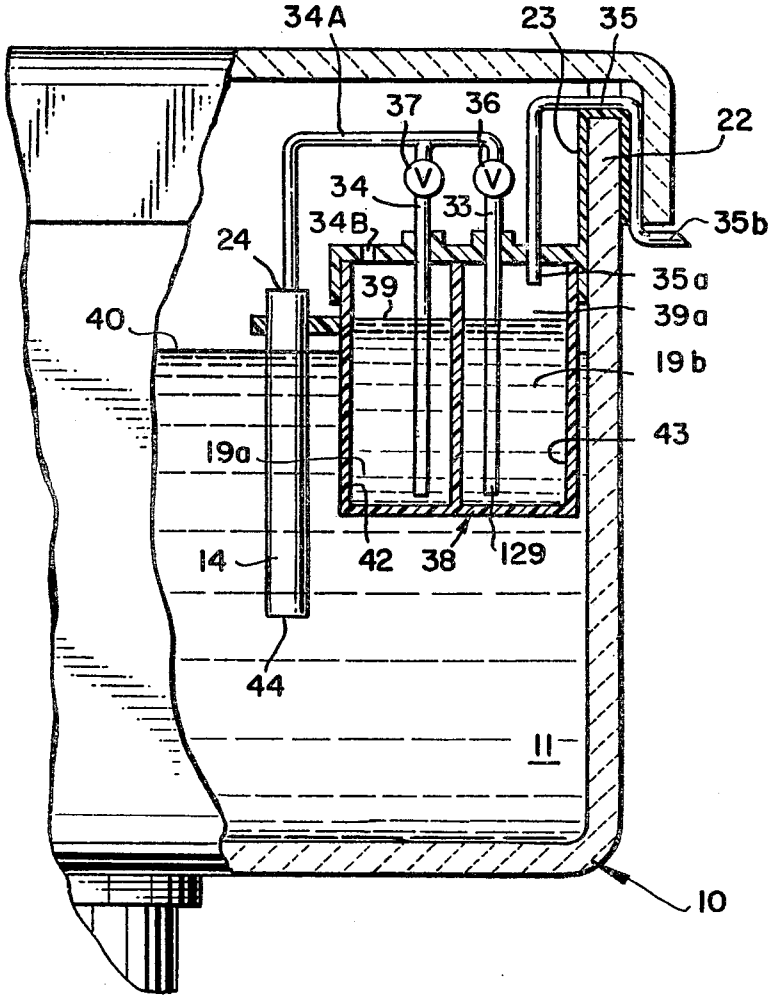
FIG. 16 is a variation of the apparatus of my invention illustrated in FIG. 10 whereby the air traveling through the second conduit means (said air being under pressure as a result of the rising fluid level in the flush tank, during phase II of the flush cycle) also passes through an air diffusing tube connected to the terminal point of the second conduit means (located proximate to the bottom of the container means) whereby (i) the air bubbles are of a much smaller diameter than the internal diameter of the second conduit means, and (ii) the number of air bubbles/volume of additive fluid is greater than when not using such an air diffusing tube, thereby causing the surface area of air in connect with additive liquid/unit time to be greater, thereby giving rise to a greater diffusion rate of aromatizer and/or deodorizer substance into the air traversing the additive liquid in the container means.
Figure 15:
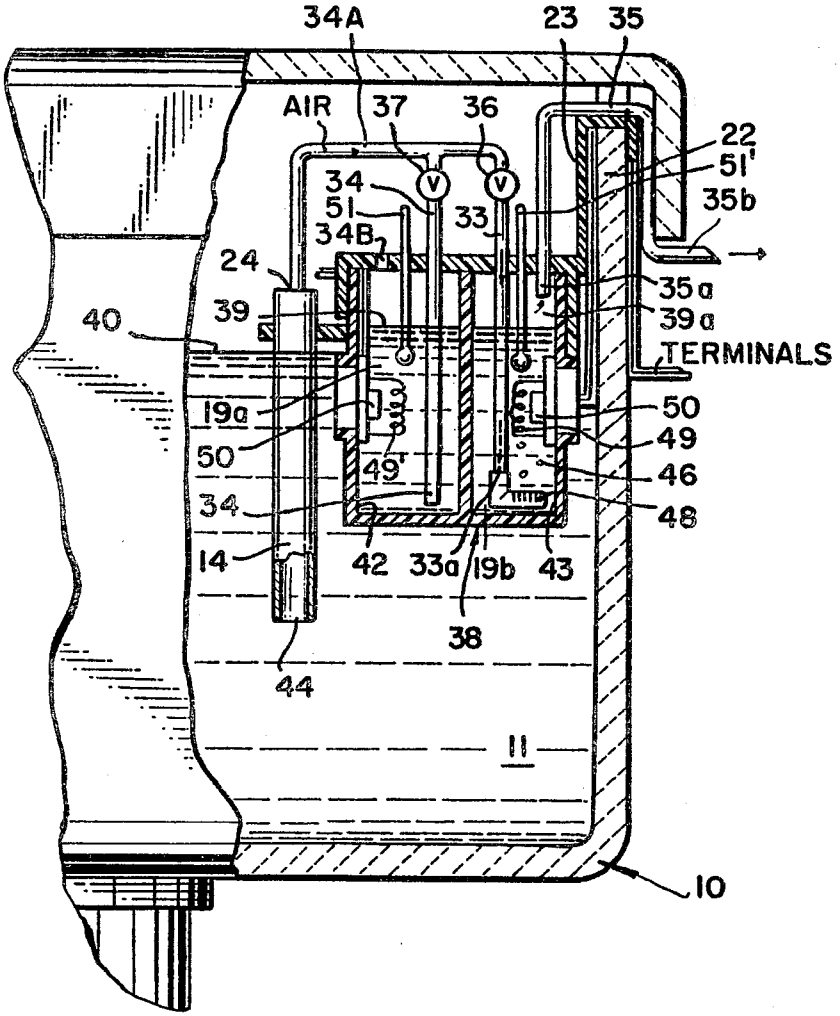
FIG. 15 is a variation of the apparatus of my invention of FIG. 14 whereby the air traveling through the second conduit means (said air being under pressure as a result of the rising fluid level in the flush tank) during phase II of the flush cycle also passes through a sparger connected to the terminal point of the second conduit means near the bottom of the container means whereby (i) the air bubbles are of a much smaller diameter than the internal diameter of the second conduit means and (ii) the number of air bubbles/unit volume of additive fluid is greater than when not using such a sparger thereby causing the surface area of air in contact with additive liquid/unit time to be greater, thereby giving rise to a greater diffusion rate of the aromatizing and/or deodorizing substance into the air covering the additive liquid.
Figure 20:
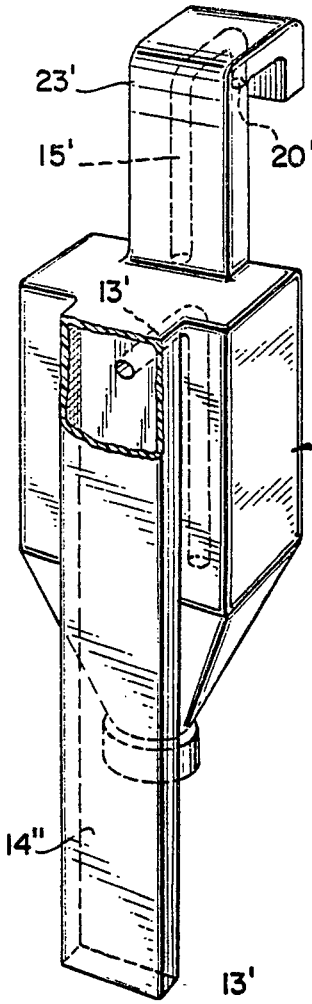
FIG. 20 is a perspective view of a variation of the apparatus of my invention as illustrated in FIG. 19, wherein the bottom portion of the container means includes a sealable and closeable opening through which the additive liquid can be replaced after the bulk of the additive liquid held in the container means is spent.
Figure 21:
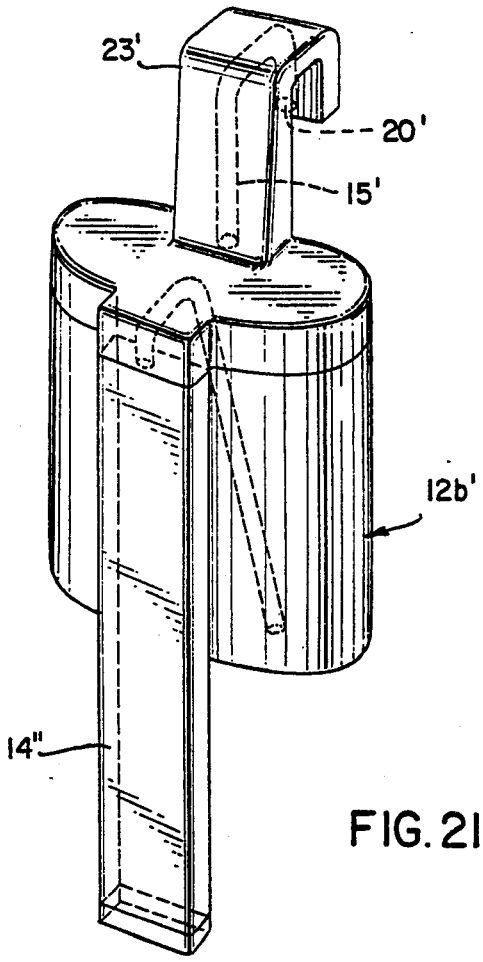
FIG. 21 is a perspective view of a geometric variation of the apparatus of my invention as illustrated in FIG. 19 wherein the top portion of the container means is detachably attached to a cap which is permanently integrated with the conduit means and the mounting clip of the apparatus of my invention.
Figure 22:
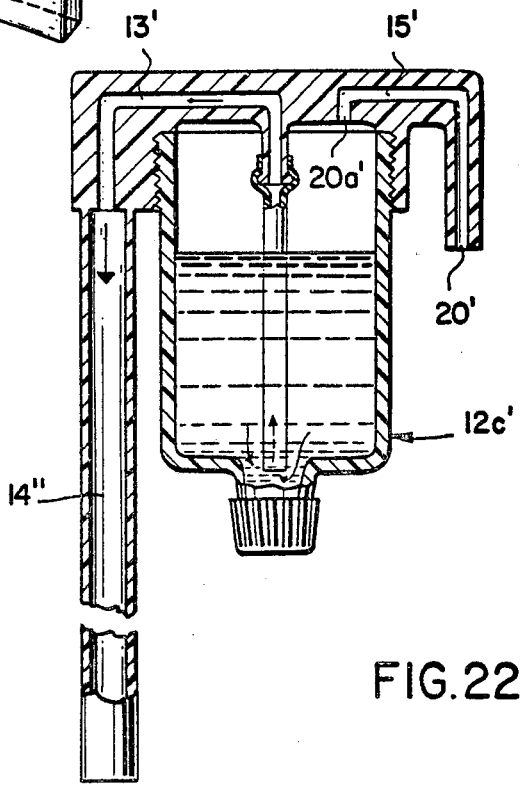
FIG. 22 is a cross-sectional view of a variation of the apparatus of my invention as illustrated in FIG. 3 wherein (i) the bottom portion of the container means includes a closeable or sealable opening through which additive liquid can be replaced after the bulk of the additive liquid held in the container means is spent and (ii) the top portion of the container means is detachably attached to a cap which is permanently integrated with the conduit means and the mounting clip of the apparatus of my invention.
Figure 23:
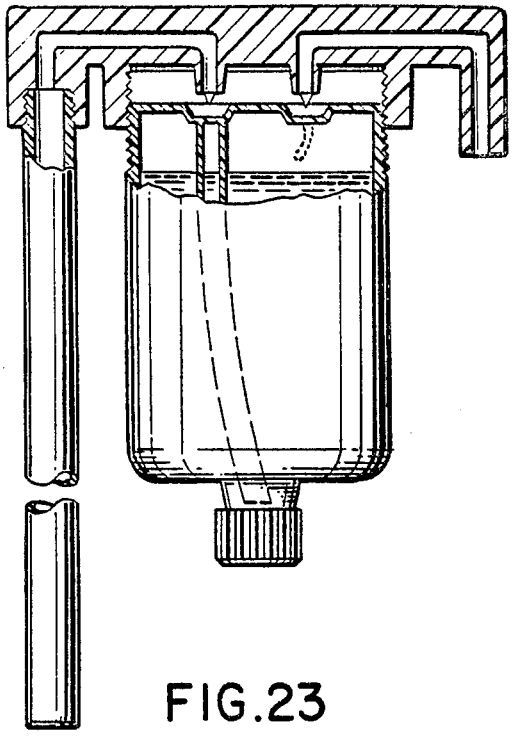
FIG. 23 is a cross-sectional view of a variation of the apparatus of my invention as illustrated in FIG. 22 wherein, prior to attaching the container means to the cap, said container means includes two pierceable closures in its top lid and the conduit means have orifices of such design that when the container is attached to the detachable cap holding the conduit means, the conduit means pierce each of the two pierceable closures.

Attached at end **33*a* of second conduit means 33, optionally, is sparger 48 (as shown in FIGS. 10, 12 and 15) or air diffusing tube 129 (as shown in FIG. 16) which causes the air bubbles travelling through said second conduit means 33 to be of a lesser diameter than the effective diameter of said second conduit means 33 thereby providing a greater surface area for diffusion of the aromatizing and/or deodorizing substance contained in compartment 43 of said container 38 to diffuse into the air within said air bubbles 46**.

Figure 11:
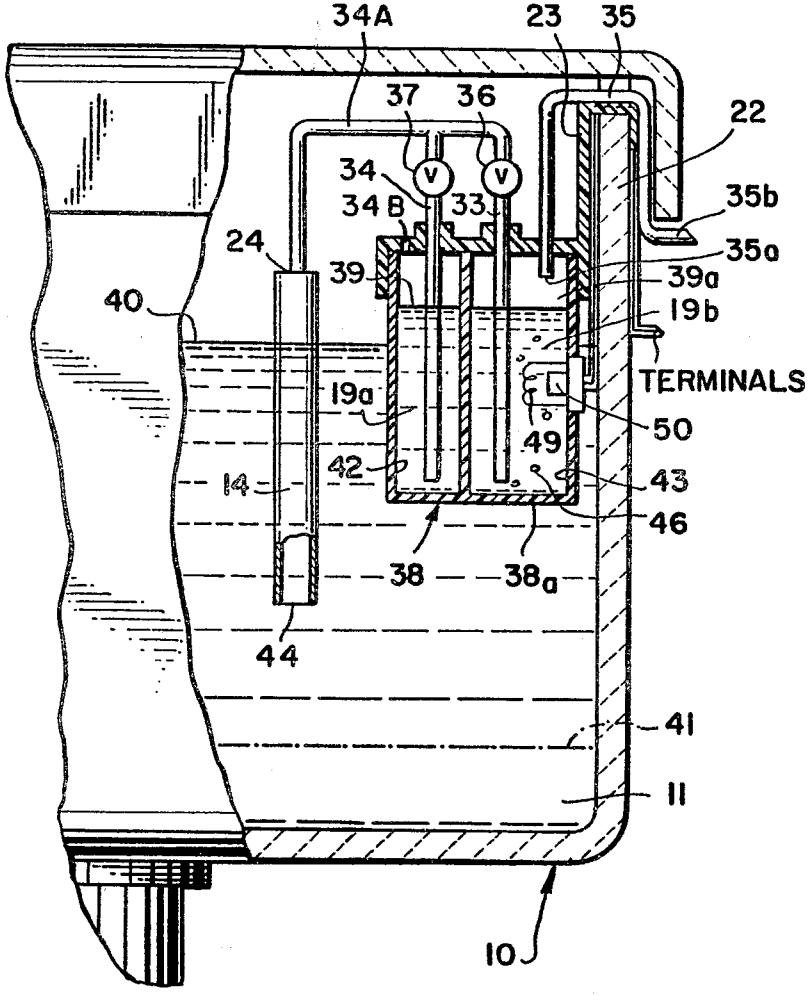
FIG. 11 is an elevation view of the apparatus of FIG. 8 shown in cross-section but also including a heating element in the aromatizing and/or deodorizing solution compartment of the container means of the apparatus of my invention.
Figure 14:
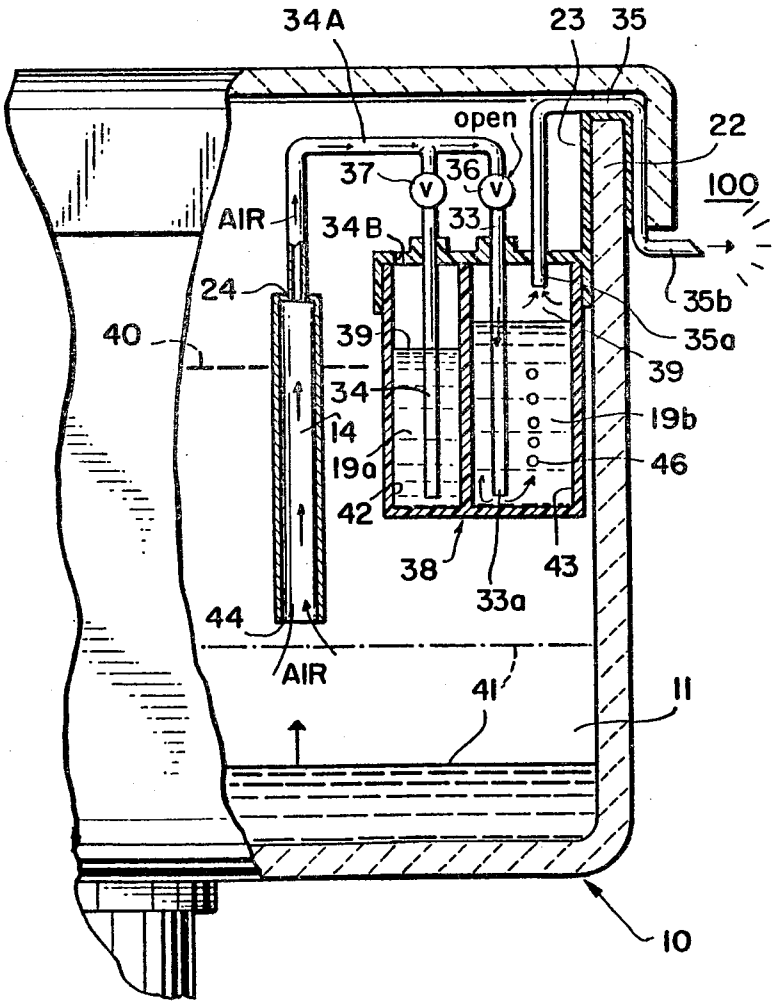
FIG. 14 is an elevation view of the apparatus of FIG. 10 shown in cross-section (with additive liquid contained in each of the compartments of the container means of the apparatus of my invention) in operation during the second phase of the flushing cycle whereby air is forced (under the pressure of the rising fluid in the flush tank) through the second conduit means (in the direction of the arrows) into the second container compartment of the container means and through the orifice located at the container end (close to the bottom of the container means) of the second conduit means whereby the moving pressurized air forms bubbles at said orifice and the bubbles travel in an upward direction through the additive liquid in the second compartment of the container means, to the surface of said additive liquid in the container means. The air above said surface containing the aromatizing and/or deodorizing substance then travels through the third conduit means into the proximate atmosphere surrounding the flush tank.
Figure 13:
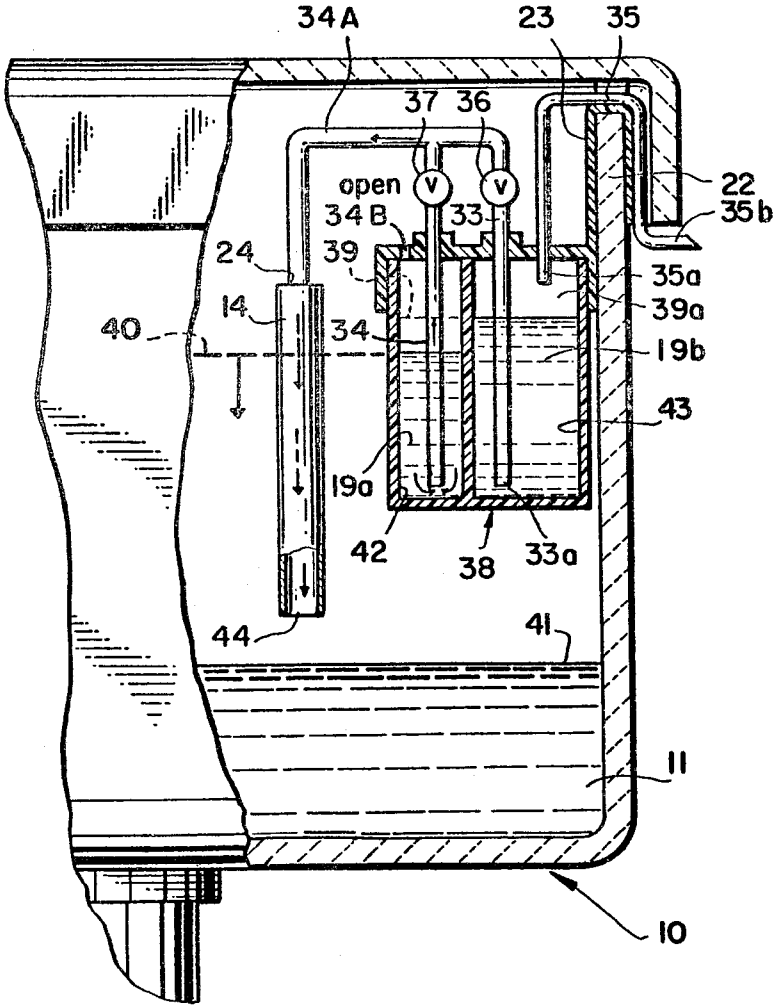
FIG. 13 is an elevation view of the apparatus of FIG. 10 shown in cross-section but containing additive liquid in the first compartment and second compartment of the container means and showing the operation of the apparatus of my invention during the first phase of the flush cycle where additive liquid is conveyed through the first conduit means from the first container compartment into the flushing liquid in the direction shown by the arrows (illustrated in said first conduit means).

Also, optionally, as is shown in FIG. 11, heating element 49 associated with and controlled by thermostat 50 may be located within compartment 43 of container 38 whereby the thermostat 50 controls the heat output of said immersion heater 49 causing additive liquid **19*b* in container 38 to have a constant elevated temperature $(T+\Delta T)$ as measured by thermometer 51**, (wherein T is the ambient temperature of the additive liquid prior to heating and $\Delta T$ is the constant differential between the ambient temperature and the elevated temperature caused by use of the immersion heater).

Also, optionally, as is shown in FIG. 12, two immersion heaters 49 and 49' may be contained, respectively, in compartments 42 and 43 of container 38 associated with, respectively, thermostats 50 and 50' whereby the temperatures $(T+\Delta T)_{19a}$ and $(T+\Delta T)_{19b}$ of both additive liquids **19*a* and 19*b*, respectively, contained in compartments 42 and 43 may be maintained at elevated level as measured by thermometers 51 and 51'. Higher temperatures of the additive liquids will give rise to more rapid diffusion of the respective solutions (a) in the flush tank fluid, in the case of the additive liquid 19*a* contained in compartment 42 and (b) into the atmosphere in the case of the aromatizing and/or deodorizing substance 19*b* contained in compartment 43 of container 38**.

Figure 25:
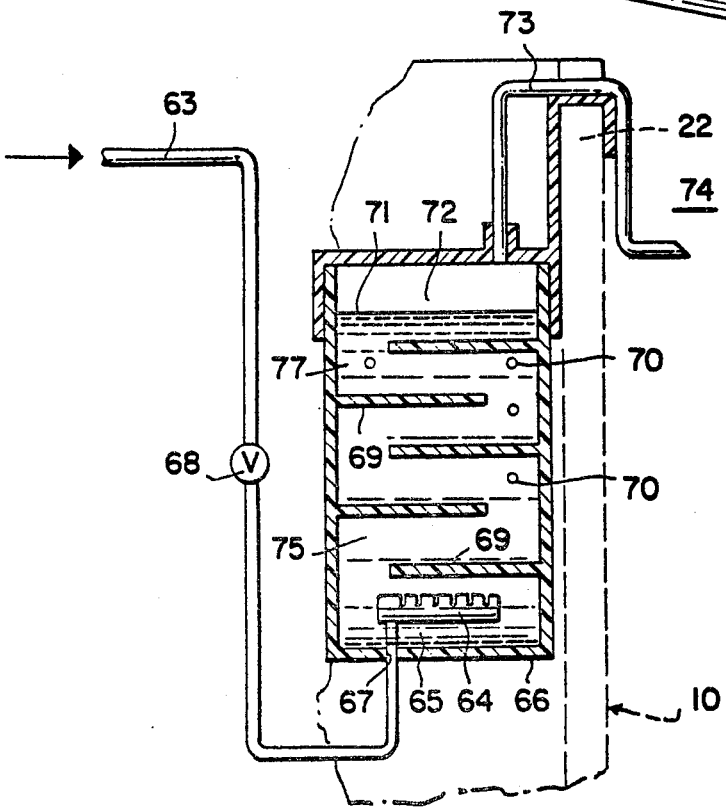
FIG. 25 is an elevation view of a variation of the apparatus of my invention shown in cross-section wherein (a) a second conduit means intended to transport air into deodorizer and/or aromatizer solution, enters a compartment of the container means of my apparatus from beneath the container means and (b) baffles are included as an integral part of the container means thereby lengthening the mean free path of the air bubbles being transported from the second conduit means to the liquid surface of the aromatizing and/or deodorizing liquid held in the container means.

Also, optionally, as shown in FIG. 25, the second conduit means 63 leading from the flush tank 10 to sparger 64 may enter the second compartment 65 from beneath the container 66 at 67. As the flush tank fluid level rises, air is forced through conduit means 63, past one-way valve 68, through sparger 64 into the additive liquid. Baffles 69, which are part of compartment 65 cause the path of air bubbles 70 to be greater than in the absence of such baffles, causing the residence time per bubble to be lengthened thereby causing the quantity of aromatizing and/or deodorizing substance diffusing into each air bubble prior to its reaching additive liquid surface 71 to be greater than if no baffles were present. The thus transported air then passes through head space 72 in container 66 and through third conduit means 73 to the proximate atmosphere 74 surrounding the flush tank.

Also, optionally, a color indicator substance may be included in cleanser and/or sanitizer and/or aromatizing and/or deodorizing additive liquids 75 and 76 contained in compartments 65 and 77. The color of the color indicator changes when the concentration of cleanser and/or sanitizer and/or aromatizer and/or deodorizer substance dissolved in the additive liquid reaches a given minimum level. Such an indicator system (specifically for aromatizing substances) is specified in French Pat. No. 2,356,431 wherein the color indicator system comprises a reactive component (I) which changes on contact with the atmosphere, an indicator (II) which changes color as the reactive component (I) changes, and the aromatizing and/or deodorizing and/or sanitizing and/or cleansing substance. One proviso is that the deodorizing and/or aromatizing and/or cleansing and/or sanitizing substance must be chosen such that the indicator (II) changes color to indicate when the said effective substance or substances is (are) exhausted. Preferably, the indicator (II) is a standard pH indicator and the reactive component (I) is a volatile acid such as hyprochloric acid, acetic acid, malonic acid, lactic acid, succinic acid or benzoic acid or a volatile base such as 2-amino-2-methyl-1-propanol, 2-methyl-amino-2-methyl-1-propanol, monoethylamine, diethylamine, morpholine, di-n-butylamine, di-isopropylamine or ammonium hydroxide.

The following examples serve to illustrate embodiments of our invention as it is now preferred to practice it, with reference to using a cleansing-sanitizing-aromatizing additive 19 contained in container 12. It will be understood that these examples are illustrative and that the invention is to be restricted thereto only as defined in the appended claims.

EXAMPLE I

Into a container 12 as shown in FIG. 3 is placed a solution containing the following ingredients:

1. 99 cc of sanitizer/cleanser composition containing the following material:

| Ingredient | Parts by Weight |
|---|---|
| Hydrochloric Acid, 27% | 25.00 |
| Triton X-100 (Polyoxyethylene [9] octylphenyl ether otherwise known as octoxynol-9 having the formula $C_8H_{12}C_6H_4(OCH_2CH_2)_nOH$ wherein n is approximately 9 and having a viscosity of 240 centipoises at 25° C. and a specific gravity of between 1.05 and 1.06 at 25° C. manufactured by the Rohm & Haas Company of Philadelphia, Pa.) | 10.75 |
| Hyamine® 1622 (a di-isobutyl-phenoxy-ethoxyethyl dimethyl benzyl ammonium chloride monohydrate having a molecular weight of 466.09 and a formula 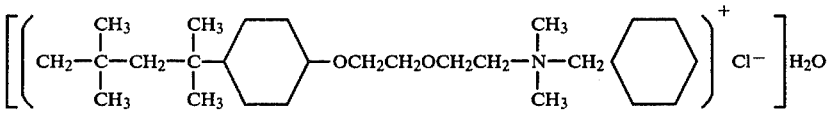 manufactured by the Rohm & Haas Company of Philadelphia, Pa. | 0.50 |
| Distilled water | 62.75 |

2. 1 cc of a perfume composition having a jasmine aroma comprising the following ingredients is prepared:

| Ingredients | Parts by Weight |
|---|---|
| Para Cresol | 1 |
| Acetyl Methyl Anthranilate | 20 |
| Farnesol | 4 |
| Cis-3-Hexenyl Benzoate | 30 |
| Nerolidol | 30 |
| Indol | 15 |
| Eugenol | 20 |
| Benzyl Alcohol | 40 |
| Methyl Linoleate | 40 |
| Jasmin Lactone | 10 |
| Dihydromethyl Jasmonate | 10 |
| Linalool | 150 |
| Benzyl Acetate | 400 |
| Abietyl Alcohol | 150 |
| Cis Jasmone | 50 |

The perfume composition and the sanitizer/cleanser composition are admixed in a ratio of 1% perfume composition and 99% sanitizer/cleanser composition. The resulting solution is used as additive liquid 19 in container 12 and 100 cc of said solution are placed into a 200 cc container 12 as illustrated in FIG. 3. The container is set up with the remainder of the apparatus of my invention in accordance with FIG. 3 in a standard flush toilet tank 10. When the toilet is flushed on the first phase of the flush cycle, the sanitizer-cleanser-jasmine perfume formulation is added to the liquid of the flush tank. On the second phase of the flush, the surrounding air around the toilet flush tank 10 has a pleasant jasmine aroma which overcomes any foul aroma in the air surrounding the toilet flush tank 10.

EXAMPLE II

A procedure similar to that of Example I is carried out with the exception that the apparatus used in the apparatus specifically illustrated in FIG. 7. Prior to commencing the flush cycle, the liquid 19 in container 12 is brought to a temperature of 50° C. and maintained at that temperature in a steady-state condition by use of the heating apparatus and a thermostat attached thereto. Subsequent to the second phase of the flush cycle, the atmosphere surrounding the flush tank has no foul odors and has a pleasant jasmine odor of a higher strength than the aroma surrounding the flush tank when the flush tank cycle is carried out according to Example I. The relative strengths are about 1.25:1 comparing Example II to Example I.

EXAMPLE III

A procedure is carried out using the apparatus illustrated in FIG. 25 and the procedure of Example II except that the perfume strength is 3% of the deodorizer-sanitizer-aromatizer composition. After the second flush cycle is completed, the atmosphere surrounding the flush tank has no foul odors and has an intense jasmine aroma which lasts for about thirty minutes subsequent to the termination of the flush cycle. The relative strength of the jasmine aroma of this Example III compared to the strength of the jasmine aroma surrounding the flush tank after completion of the flush cycle in Example II is about 1.5:1.

I claim:

1. A process comprising the steps of dispensing a measured amount of odorant or deodorant vapor into the atmosphere surrounding a flush tank toilet and simultaneously dispensing a measured amount of one or more solutions selected from the group consisting of a cleanser solution, a sanitizer solution, an aromatizer solution and a deodorizer solution into the liquid stored in the flush tank by using apparatus wherein said flush tank is of the type which retains a flushing liquid which lowers and rises between a first upper level and a second lower level during flushing, said apparatus including:

(i) container means for retaining the additive liquids in solution;

(ii) first conduit means having outlet opening means and inlet opening means, said first conduit means communicating between said container means and an inlet opening means positionable in said flush tank intermediate said first and second levels of the flushing liquid to admit air into the first conduit means when the flushing liquid lowers below the inlet opening means, said inlet opening means being positionable sufficiently below said first level for the flushing liquid to force air through the first conduit means into the container means as the flushing liquid level rises above the inlet opening means towards said first level; said first conduit means also communicating between said additive liquid in the container means and said outlet opening means positionable in said tank for passage of additive liquid into the flushing liquid whereby the level of said outlet opening means is substantially below the bottom level of said solution in said dispensing apparatus, said apparatus having in combination:

a. Said first conduit means which communicates between said container means and said inlet opening means consisting essentially of a first tube having a first inside diameter and a second tube having a second inside diameter, said first tube being positioned from a point in proximity to the bottom of said container means and passing through the top of said container means above the level of said additive liquid solution and then in a downward direction to a point which is at substantially a level identical to the level of the bottom of said container means which retains said additive liquid solution, the end of said first tube having said first inside diameter being said outlet opening means for said conduit means for passage of additive liquid into the flushing liquid, said outlet of said first tube being fixedly connected in a sealed manner to said second tube having said second inside diameter, said second tube having said second inside diameter passing from said outlet means of said first tube to said inlet opening means positionable in said tank intermediate said first and second levels of the flushing liquid to admit air into the first conduit means when the flushing liquid lowers below the inlet opening means, and b. a second conduit means communicating from a level above the highest level of the additive liquid solution retained in said container means into the air surrounding said flush tank;

c. the ratio of said second inside diameter to said first inside diameter being in the range of from about 2:1 up to about 5:1, whereby during the flushing, during the first cycle thereof, when the flushing liquid lowers from the first upper level to the second lower level, additive liquid is siphoned from said container means into said flushing liquid and during the second phase of the flushing cycle, when the flushing liquid rises from said second lower level to said first upper level, air forced into said second tube of said first conduit means and into said container means in the form of air bubbles which travel to the upper level of said additive liquid solution held within said container means and whereby aromatizing or deodorizing substance contained in said additive liquid solution is diffused into said travelling air bubbles so that when the air bubbles reach the upper surface of said additive liquid solution held in said container means the gaseous phase is a mixture of air and aromatizing or deodorizing substance and the mixture of air and aromatizing or deodorizing substance then travels through said second conduit means into the atmosphere surrounding said flush tank.

2. The process of claim 1 wherein in said apparatus said container means also includes a heating element being capable of intermittent controlled heating and thermostat means controlling the heat output of said heating element, said heating element being immersed in said additive liquid solution contained in said container means.

3. The process of claim 1 wherein in said apparatus the terminating point of said first conduit means located in said container means has fixedly attached thereto a sparger or air diffuser which causes said air bubbles to have an average diameter less than said first diameter of said first tube.

4. The process of claim 1 wherein said additive liquid solution contains in addition to said aromatizing or deodorizing material or cleanser or sanitizing substance, a visual indicating material comprising a second liquid having a color which contrasts with the color of said additive liquid solution.

5. A process comprising the step of dispensing a measured amount of aromatizing or deodorizing vapor into the atmosphere surrounding a flush tank toilet and also during the same flush cycle dispensing a measured amount of sanitizing-cleansing solution into the flushing liquid which lowers and rises between a first upper level and second lower level during flushing using apparatus comprising:

(i) container means for retaining additive liquid solution;

(ii) first conduit means communicating between said additive liquid in the container means and outlet opening means positionable in the tank for passage of said additive liquid into the flushing liquid;

(iii) second conduit means communicating between said container means and inlet opening means positionable in said tank intermediate said first and second levels of the flushing liquid to admit air into said second conduit means when the flushing liquid lowers below the inlet opening means, said inlet opening means being positionable sufficiently below said first level for the flushing liquid to force air into the container means as the flushing liquid rises above the inlet opening means towards said first level from said second level; and (iv) third conduit means communicating from a position above the highest level of the additive liquid in said container means outward from said container means into the atmosphere surrounding the flush tank, wherein said apparatus is further defined as comprising:

a. one-way valve means contained in said first conduit means for permitting passage of said additive liquid from said container means into said flushing liquid as said flushing liquid level lowers from said first upper level to said lower level during the first phase of the flushing cycle but preventing air from travelling through said first conduit means from said flushing tank into said additive liquid when said level of said flushing liquid rises from said second lower level to said first upper level;

b. second one-way valve means associated with said second conduit means for permitting passage of air from said inlet opening means to the container means and for preventing passage of additive liquid from the container means to the inlet opening means;

c. said container means retaining said additive liquid solution being divided into two compartments, a first compartment and a second compartment, said first compartment containing an additive solution which comprises a cleanser-sanitizer liquid and said second compartment containing a solution comprising an aromatizing or deodorizing solution, said first conduit means terminating in said first compartment in proximity to the bottom of said container means and said second conduit means terminating in said second container compartment in proximity to the bottom of said container means;

whereby the air forced into the container means through said second conduit means evolves into the additive solution in said second compartment of said container means in the form of bubbles which rise to the upper level of said additive liquid during which time aromatizing or deodorizing substance diffuses from the additive solution into each of the air bubbles.

6. The process of claim 5 wherein in the apparatus the terminating opening of said second conduit means has attached thereto a sparger or air diffuser causing the diameters of the air bubbles evolving therefrom during the second phase of the flushing cycle to be smaller than the effective internal diameter of said second conduit means.

7. The process of claim 5 wherein in the apparatus the second compartment of said container means contains a heating element immersed therein which evolves heat controllably and intermittently and a thermostat means associated with said heating element which controllably and intermittently causes said heating element to maintain the temperature of said additive liquid in said second compartment means at a fixed temperature.

8. The process of claim 7 wherein in the apparatus a heating element and thermostat means are included in said first additive solution compartment whereby said heating element emits heat intermittently and controllably and said thermostat controls said evolution of heat whereby the temperature of the additive solution in said first compartment is maintained at a fixed level.

9. The process of claim 6 wherein the additive solution in said first compartment is maintained at a fixed level.

10. The process of claim 6 wherein the additive solution in said first compartment of said container means also contains a color indicator having a color which contrasts to the color of the additive liquid contained in said first compartment of said container means.

11. The process of claim 6 wherein in the apparatus said container means includes in the inner portion thereof baffles disposed in a horizontal manner below the maximum level of the additive liquid and above the terminating opening of said second conduit means.

12. A process comprising the step of simultaneously causing a (i) first liquid which is a cleansing and/or sanitizing and/or deodorizing and/or aromatizing solution to flow from a fixed container means into the water of a toilet flush tank to cleanse and/or sanitize and/or deodorize and/or aromatize the water of said toilet flush tank and an (ii) aromatizing and/or deodorizing emission of fixed duration evolving from said fixed container means to aromatize and/or deodorize the air in the vicinity of said toilet flush tank by using (i) the lowering level of water in the said toilet flush tank during the first phase of flushing to cause said first liquid which is cleansing and/or sanitizing and/or deodorizing and/or aromatizing to be emitted from said container means into said water and (ii) the rising level of water in the said toilet flush tank during the second phase of flushing to cause aromatizing and/or deodorizing vapor to diffuse from a second aromatizing and/or deodorizing liquid into air bubbles produced within said container means as a result of said rising level of water, said air bubbles rising to the upper surface of the aromatizing and/or deodorizing liquid in said container means and then into the atmosphere surrounding said flush tank.

13. The process of claim 12 wherein the first and second liquids are in said container means in intimate admixture.

14. The process of claim 12 wherein said first liquid is physically separated from said second liquid by a solid container compartment wall.

* * * * *